United States Patent [19]

Dimond et al.

[11] 4,388,204

[45] Jun. 14, 1983

[54] THICKENED ALKALI METAL HYPOCHLORITE COMPOSITIONS

[75] Inventors: Harold L. Dimond, Cincinnati, Ohio; Thomas J. Murphy, Florence, Ky.

[73] Assignee: The Drackett Company, New York, N.Y.

[21] Appl. No.: 361,031

[22] Filed: Mar. 23, 1982

[51] Int. Cl.[3] ..... C11D 3/395; C11D 7/52

[52] U.S. Cl. ..... 252/98; 252/99; 252/102; 252/103; 252/156; 252/173; 252/527; 252/531; 252/546; 252/550; 252/DIG. 14

[58] Field of Search ..... 252/98, 99, 102, 103, 252/156, 173, 527, 531, 546, 550, DIG. 14

[56] References Cited

U.S. PATENT DOCUMENTS

| | | | |
|---|---|---|---|
| 3,558,496 | 1/1971 | Zmoda | 252/95 |
| 3,560,389 | 2/1971 | Hunting | 252/95 |
| 3,684,722 | 8/1972 | Hynam | 252/98 |
| 3,697,431 | 10/1972 | Summerfelt | 252/103 |
| 3,843,548 | 10/1974 | James | 252/187.26 |
| 3,929,661 | 12/1975 | Nakagawa et al. | 252/103 |
| 3,956,158 | 5/1976 | Donaldson | 252/102 |
| 3,985,668 | 10/1976 | Hartman | 252/99 |
| 4,005,027 | 1/1977 | Hartman | 252/95 |
| 4,011,172 | 3/1977 | Marsan et al. | 206/0.5 |
| 4,057,505 | 11/1977 | Nakagawa | 252/96 |
| 4,071,463 | 1/1978 | Steinhauer | 252/103 |
| 4,116,849 | 9/1978 | Leikhim | 252/103 |
| 4,116,850 | 9/1978 | Ruck | 252/103 |
| 4,116,851 | 9/1978 | Rupe et al. | 252/103 |
| 4,147,650 | 3/1979 | Sabatelli et al. | 252/103 |
| 4,154,694 | 5/1979 | Donaldson | 252/98 |
| 4,155,871 | 5/1979 | Donaldson | 252/156 |
| 4,229,313 | 10/1980 | Joy | 190/18 A |
| 4,235,732 | 11/1980 | Beyer | 252/103 |
| 4,271,030 | 6/1981 | Brierley et al. | 252/98 |
| 4,282,109 | 8/1981 | Citrone et al. | 252/102 |
| 4,316,812 | 2/1982 | Hancock et al. | 252/99 |
| 4,337,163 | 6/1982 | Schlip | 252/96 |

FOREIGN PATENT DOCUMENTS

| | | |
|---|---|---|
| 1466560 | 3/1977 | United Kingdom . |

*Primary Examiner*—John E. Kittle
*Assistant Examiner*—Robert A. Wax
*Attorney, Agent, or Firm*—Sherman & Shalloway

[57] ABSTRACT

Thickened aqueous alkali metal hypochlorite compositions are provided by adding to the aqueous solution of the hypochlorite an effective amount of a thickening additive composed of at least one of each of the following classes of anionic surfactants: (A) alkali metal sulfate salts of ethoxylated aliphatic alcohols; (B) alkali metal salts of N-alkyl, N-acyl amino acids, and (C) alkali metal salts of alkyl sulfates. The thickened compositions have viscosities of at least 25 centipoises and remain stable—no phase separation; maintain viscosity and hypochlorite concentration—for extended periods. Compositions especially useful for unclogging clogged drains, preferably those with P-traps, are described.

22 Claims, No Drawings

THICKENED ALKALI METAL HYPOCHLORITE COMPOSITIONS

DESCRIPTION

BACKGROUND OF THE INVENTION

1. Field of the Invention

This invention relates to stable thickened alkali metal hypochlorite bleaching compositions. More particularly, this invention is concerned with thickened compositions of alkali metal hypochlorites suitable as a clogged drain opening composition, or for other bleaching applications, which compositions, in terms of viscosity and hypochlorite content, are stable for many months and even years.

2. Discussion of the Prior Art

Aqueous solutions of alkali metal hypochlorite bleaching agents are widely used in the bleaching of textile materials, as well as in general purpose cleaning and bleaching of hard surfaces, including dishes, glasses, metal surfaces, pots, pans, and the like. In addition, in view of the capability of the bleaching agents to attack protein fibers such as hair and food particles, which are often the cause of clogged drains in bathroom and kitchen sinks, aqueous compositions containing alkali metal hypochlorite are used as liquid drain opening compositions, usually in combination with alkali metal hydroxide. Such a composition is disclosed in U.S. Pat. No. 3,697,431 to Summerfelt.

Summerfelt teaches that wetting agents, or surface active agents, in amounts of from 0.25% to up to about 1% by weight, may be utilized to increase the rate at which the drain opener penetrates the fatty substance which clogs the drain. In amounts in excess of 1%, deterioration of the hypochlorite is accelerated. Anionic monophosphate esters of an ethoxylated alcohol or the salts of a perfluoroacid are the only hypochlorite and hydroxide compatible wetting agents mentioned.

U.S. Pat. No. 4,116,850 to Ruck discloses drain opener compositions which are aqueous solutions of a soluble metallic hydroxide, a chlorine releasing agent, and a catalyst which is a metallic chloride of a Group VI metal.

There is no suggestion of adding any thickening agents in either the Summerfelt or Ruck patents. However, thickened alkali metal hypochlorite bleaching and cleaning compositions have been suggested in view of the advantage of thickened compositions in bleaching and/or cleaning vertical surfaces. The use of various types of clays and/or polymeric or cellulosic thickeners in aqueous alkali metal hypochlorite compositions is described in the following U.S. Pat. No.: 3,558,496—Zmoda (mixture of positively charged clay and negatively charged clay); U.S. Pat. No. 3,843,548—James (paste or gel for medicinal or veterinary purposes—using synthetic magnesium silicate clay); U.S. Pat. Nos. 3,985,668 and 4,005,027—Hartman (false body, fluid abrasive scouring composition—using clays as colloid-forming thickening agents); U.S. Pat. No. 4,011,172—Marsan, et al (for automatic clothes dryer—using colloidal silicas, polyacrylamides, cellulose derivatives, e.g. carboxymethylcellulose, or clays of various types, e.g. smectite and Laponite); U.S. Pat. No. 4,071,463—Steinhauer (Laponite clay-example 5); U.S. Pat. No. 4,116,849—Leikhim and U.S. Pat. No. 4,116,851—Rupe, et al (natural or synthetic clay, colloidal silica, particulate polymers, carboxypolymethylene); U.S. Pat. No. 4,147,650—Sabatelli et al (slurried detergent—sodium tripolyphosphate and sodium polyacrylate); U.S. Pat. No. 4,235,732—Beyer (clay-as suspending and false-body agent).

The use of various detergents or surface-active agents for providing a thickening function in alkali metal hypochlorite bleach containing compositions has also been suggested. For example, mention can be made of the following U.S. Pat. No.: 3,684,722—Hynam, et al (mixtures of $C_8$—$C_{13}$ alkali-metal soaps with amine oxides or long chain substituted betaines); U.S. Pat. Nos. 3,956,158, 4,154,694 and 4,155,871—Donaldson (combination of 3-dimensional network of entangled filaments of insoluble material, including fatty acid soaps, e.g. sodium stearate, with a mixture of detergent-active compounds, i.e. a mixture of alkali metal $C_{12}$ to $C_{18}$ alkyl sulphates with trialkyl amine oxide, trialkyl phosphine oxide or dialkyl sulphoxide detergent-active materials); U.S. Pat. No. 4,229,313—Joy (branched chain amine oxides of formula $R—CH(R_1)—CH_2—NR_2R_3 \rightarrow O$); U.S. Pat. No. 4,271,030—Brierly, et al (detergent micellar complexes); U.S. Pat. No. 4,282,109—Citrone, et al (blend of amine oxide and alkali metal alkyl sulfate).

Also, British Pat. No. 1,466,560, which is referred to in the Brierly, et al and Citrone, et al U.S. patents, discloses a thickened aqueous alkali metal hypochlorite composition in which thickening is imparted by an admixture of certain sarcosinate or tauride surfactants, in an amount of 0.1 to 5% by weight, with one or more of the surfactants: soaps, certain quaternary ammonium compounds, amine oxides, betaines and alkanolamides, in an amount of from 0.1 to 5% by weight. Stability at room temperature for several weeks is observed.

However, there is still a need for thickened aqueous alkali metal hypochlorite compositions of improved stability both with regard to the hypochlorite concentration and the viscosity of the composition, as well as with respect to phase stability, i.e. there should not be any phase separation of the composition during storage, even over extended periods.

A major difficulty in finding suitable organic thickeners lies in the interaction between thickeners and hypochlorites. Because of this interaction, both viscosity and hypochlorite concentration decrease as a function of time. The rate of hypochlorite degradation that occurs as a result of the interaction with the thickener is typically much faster than the reduction in hypochlorite concentration taking place in commercial hypochlorite solutions according to the equation:

$$NaOCl \rightarrow NaCl + \tfrac{1}{2}O_2 \uparrow .$$

In many instances the compositions split into two phases. Moreover, many conventional thickeners are simply ineffective when used in aqueous hypochlorite compositions.

The problem of compatibility and stability between many classes or organic surface-active compounds and hypochlorite and the ineffectiveness of many conventional thickeners is well recognized and is discussed in several of the above mentioned patents. For example, Hynam, et al U.S. Pat. No. 3,684,722 teaches the ineffectiveness of various polymeric thickeners, Veegum T, celluloses, silicones, water glass, bentonite, liquid paraffin, and sodium stearate (soap); Hartman, U.S. Pat. Nos. 3,985,668 and 4,005,027 teaches that alkyl benzene sulfonates, olefin sulfonates, alkyl glyceryl ether sulfonates, alkyl ether sulfates and ethoxylated nonionic surfactants are to be avoided, while bleach stable surfactants that are especially resistant to hypochlorite oxidation fall into two main groups: water-soluble alkyl sulfates containing from about 8 to 18 carbon atoms in the alkyl group and water-soluble betaine surfactants.

U.S. Pat. No. 3,560,389 to Hunting discloses a liquid detergent bleach composition containing alkali metal hypochlorite, a bleach compatible detergent and a hydrotrope as a means of providing a clear, stable formulation which does not lose its oxidizing and/or detergent powers. Four suitable classes of detergents are described, including alkali metal sulfates, e.g. sodium lauryl sulfate; alkali metal ether sulfates, e.g. sodium lauryl ether sulfate; alkali metal alkylaryl sulfonate, e.g. sodium dodecyl benzene sulfonate; and oxidation products of fatty amines, i.e. amine oxides. It is also indicated that mixtures of these detergents may be used, although mixtures with other unnamed detergents may not be compatible. Hunting does not mention any thickening being provided by these detergents nor are any ranges of proportions given for mixtures of detergents.

It has now been found that even among the classes of surfactants described in these patents as being compatible with and providing stable compositions with alkali metal hypochlorites generally only a few of the many surfactants in each class are in fact stable enough for commercial applications. Although the reason for this "selectivity" of stability within specific classes or types of surfactant materials has not been fully understood, it is hypothesized that the presence of impurities in the commercially available materials, e.g. trace heavy metals (Co, Ni, Cu), alcohols, —NH—compounds, oxidizable organic compounds, etc. may be one cause for breakdown in the hypochlorite either by reaction or by catalysis.

Further extensive experiments and research to find hypochlorite compatible surfactants and especially surfactant mixtures revealed that only certain combinations of surfactant compounds and then only in certain critical proportions were capable of providing stable thickened hypochlorite bleaching compositions.

Moreover, it has now been discovered that for one intended utility of the thickened alkali metal hypochlorite compositions, namely, for unclogging clogged drains, improvement in flow rates requires a relatively narrow range of viscosity.

Accordingly, it is an object of the invention to provide stable thickened alkali metal hypochlorite compositions.

It is another object of the invention to provide a mixture of readily available anionic surface active compounds which can be used to increase the viscosity of alkali metal hypochlorite compositions.

It is still another object of the invention to provide a thickened alkali metal hypochlorite composition for unclogging clogged drains which is not expensive to produce and which remains stable for extended periods of time with regard to both product viscosity and hypochlorite ion concentration, as well as to phase stability.

A still further object of the invention is to provide a cleaning and bleaching composition which has a viscosity especially effective for unclogging clogged drains with P-type traps.

SUMMARY OF THE INVENTION

These and other objects of the invention, which will become more apparent from the following detailed description, are accomplished by a mixed anionic surfactant composition capable of stably thickening an aqueous solution of an alkali metal hypochlorite, wherein the mixed anionic surfactant composition comprises a thickening additive composed of at least one compound selected from each of the following three classes (A), (B) and (C) of surface active anionic surfactant compounds:

(A) alkali metal sulfate salts of ethoxylated aliphatic alcohols;

(B) alkali metal salts of N-alkyl, N-fatty acyl amino acids; and (C) alkali metal salts of alkyl sulfates;

with the amounts of each based on the total weight of (A)+(B)+(C) being, respectively, in the range of from about 3% to about 40%, from about 10% to about 50%, and from about 30% to about 75%.

The mixed anionic surfactant composition can be a dry powdery mixture of the (A), (B) and (C) surfactant components of the thickening additive, but preferably the mixed anionic surfactant composition is provided as an aqueous solution or emulsion of the thickening additive composed of the (A), (B) and (C) surfactant components. In the latter case, the concentrations of (A), (B) and (C) in the aqueous solution or emulsion conveniently provide a total concentration of the thickening additive in the range of from about 5% to about 50% by weight of the total mixed anionic surfactant composition.

In another aspect, the present invention provides a shelf-stable thickened aqueous liquid alkali metal hypochlorite bleaching composition which is stably thickened by adding to the aqueous solution of the alkali metal hypochlorite an amount of the mixed anionic surfactant composition that provides a total amount of the thickening additive and amounts of each of surfactant components (A), (B) and (C) to provide a viscosity of at least 25 centipoises, the bleaching composition having a half-life of the alkali metal hypochlorite concentration of about six months, and a phase-stability of about six months.

The bleaching composition may also preferably include the usual amounts of such conventional bleaching composition ingredients as alkali metal hydroxide for its capability to attack proteins and to adjust the pH, an alkali metal silicate for its ability to protect against corrosion of metal surfaces and other optional adjuvants, such as, for example, perfumes, coloring agents, etc.

Generally, the thickened aqueous hypochlorite bleaching composition includes (a) from about 1 to about 12% of the alkali metal hypochlorite, (b) from about 0 to about 10% by weight of an alkali metal hydroxide, (c) from about 0 to about 5% by weight of an alkali metal silicate, (d) an effective amount of the mixed anionic surfactant composition, generally from about 0.3% to about 7%, and water.

According to a preferred aspect of the invention, a thickened aqueous liquid drain opener composition for chemically unclogging clogged drains, especially those with drain traps, is provided. The drain opening composition may include:

(a) from about 3.0 to about 8.0% by weight of an alkali metal hypochlorite, (b) from about 0.5 to about 10.0% by weight of an alkali metal hydroxide, (c) from about 0.3 to about 5.0% by weight of an alkali metal silicate, (d) from about 0.5 to about 6.0% by weight of the mixed anionic surfactant thickening additive, and (e) water, wherein the thickening additive (d) is composed of a mixture of:

(A) from about 3 to about 40% by weight of the total additive of at least one alkali metal sulfate salt of an aliphatic ethoxylated alcohol, (B) from about 10 to about 50% by weight of the total additive of at least one alkali metal salt of an N-alkyl,N-fatty acyl amino acid, and (C) from about 30 to about 75% by weight of the total additive of at least one alkali metal salt of an alkyl sulfate.

The thickened drain opener composition has a viscosity in the range of from about 25 centipoises to about 400 centipoises, preferably from about 30 to about 250 centipoises, a half-life of the alkali metal hypochlorite concentration of about six months, and a phase stability of about six months, both preferably one year.

The present invention also provides a method for chemically unclogging clogged drains, by contacting the clog with an effective amount, which will depend upon the severity of the clog, of the drain opener composition of the invention, for a sufficient time to effectively dissolve the clog. When the clog is sufficiently dissolved, water will be able to flow freely through the drain. The method may be used, for example, for clearing drains in bathrooms, kitchens, utility rooms, laundry rooms, etc. in both private and commercial establishments. When the clogged drain includes a P-trap, the drain opener composition is thickened to a viscosity in the range of from about 25 cps to about 150 cps, preferably from about 30 cps to about 100 cps; for S-trap drains, the viscosity may be as high as about 400 cps, preferably between about 150 to about 250 cps, most preferably from about 200 cps to about 225 cps.

DETAILED DESCRIPTION OF THE INVENTION

Thickened aqueous liquid hypochlorite bleaching compositions, including general purpose bleaching and cleaning compositions, as well as drain opener compositions have several advantages over the corresponding non-thickened compositions. The most important of these advantages involves the ease in treating vertical or inclined surfaces due to the slower run-off of the thickened composition. Consumer appeal may also be heightened for thickened products.

However, to assure customer satisfaction, especially at the level of the home consumer and other non-industrial type applications, it is important that the stability of the thickened products be sufficiently high that the product can remain on the shelf in the store and in the home for extended periods without undergoing degradation of product characteristics.

For thickened aqueous liquid hypochlorite bleaching compositions the most important characteristics which need to be stabilized against degradation over prolonged storage periods include the visual appearance, e.g. phase stability; the concentration of the active hypochlorite ion concentration, and the product viscosity.

Regarding phase stability, the product should remain homogeneous without breaking down into separate phases and without precipitation of any product components. In the present invention, the product is considered to have adequate phase stability if it does not separate into different phases when stored at temperatures within the range of from about 50° to about 90° F. for about six months, preferably about one year.

Regarding the hypochlorite ion concentration, the product is considered to be adequately stable if the concentration of the hypochlorite compound at the end of about six months is at least 50% of the intial concentration of the hypochlorite compound. In the present invention, when this criteria is satisfied the product is said to have a half-life of its hypochlorite concentration of six months.

Regarding the viscosity of the thickened liquid aqueous alkali metal hypochlorite bleaching compositions, it is important that the viscosity should remain within a predetermined range which will depend on the intended use of the composition over the anticipated life of the product, generally for about six months, but preferably for about one year. For thickened drain opener compositions, the viscosity should be within the range of from about 25 to about 150 cps, especially from about 30 cps to about 100 cps, when the product is intended for use with drains having P-traps, and below about 400 cps, preferably within a range of from about 150 to about 250 cps, most preferably from about 200 to about 225 cps, when the product is intended for use with drains having S-traps. These viscosity ranges, especially those given for the P-trap drains are somewhat dependent on the hypochlorite concentration but are expected to hold true for the concentration ranges described below. The most preferred hypochlorite concentration and product viscosity for P-trap drains is about 4.5% and 50 cps, respectively.

For general purpose cleaning and bleaching compositions, viscosities in the range of from about 25 to about 400 cps, preferably from about 50 to about 250 cps, are usually satisfactory.

In the present application, viscosity is measured at 20° C. using a Brookfield Model LVT viscosimeter unless otherwise indicated.

Extensive research to find suitable thickening additives for thickening aqueous solutions of alkali metal hypochlorite, especially sodium hypochlorite, included investigation of many different one-, two- and three-component systems of several different classes of surface active agents. Each of these systems was tested for its thickening effect as well as for its phase stability, hypochlorite concentration stability, and viscosity stability. As will be shown by the comparative examples given below, none of the one- or two-component surfactant additive systems was satisfactory with regard to all of these criteria, while among the three-component additive systems the overall best effects were provided by the mixed anionic surfactant compositions which are composed of the three-component thickening additive mixture of anionic surfactants (A), (B) and (C) as described herein.

The mixed anionic surfactant composition according to this invention is capable of stably thickening an aqueous solution of alkali metal hypochlorite, which may also include an alkali metal hydroxide and/or an alkali metal silicate and/or other optional adjuvants such as coloring agents, perfumes, etc. Because the thickening additive is a mixture of three different classes of anionic surfactants, the thickening additive may also exhibit a general cleaning and surface active function in the thickened bleach compositions of the invention.

The surfactant composition includes as its essential component the three surfactant system thickening additive which is composed of a mixture of (A) an alkali metal sulfate salt of an ethoxylated aliphatic alcohol, (B) an alkali metal sulfate salt of an N-alkyl, N-fatty acyl amino acid, and (C) an alkali metal salt of alkyl sulfate. All of these componenents (A), (B) and (C) are well known surface active compounds or surfactants. It is important to use the alkali metal salts of these compounds because they are soluble in aqueous systems whereas, for example, the alkaline earth metal salts are generally insoluble or only slightly soluble in aqueous systems. The alkali metal is preferably sodium, potassium, or lithium, especially preferably sodium or potassium.

One or more of the surfactant components (A), (B) and (C) may be readily commercially available in an aqueous solution or emulsion, and the components can be used in this form, in which case the mixed anionic surfactant composition will be in the form of an aqueous solution or emulsion of the thickening additive. This is the preferred embodiment. However, it is also within the scope of the invention to simply mix each of components (A), (B) and (C) in the form of dry powders. In this case, the mixed anionic surfactant composition may consist solely of the dry thickening additive powder mixture. Other additives, i.e. additives which will not adversely affect the ability of the thickening additive to stably thicken aqueous solutions of alkali metal hypochlorite according to the above described criteria of phase stability, thickening ability and hypochlorite concentration, can be added to either of these forms of the mixed anionic surfactant composition. For example, suitable additives may include one or more of coloring agents such as dyes, and/or pigments, perfumes, and the like.

The component (A) alkali metal sulfate salts of ethoxylated aliphatic alcohols are compounds of the general formula:

$$RO(CH_2CH_2O)_nSO_3^-M^+ \quad (I)$$

where R represents an aliphatic group of from 8 to 18 carbon atoms, preferably about 10 to 14 carbon atoms; M is an alkali metal, preferably sodium or potassium, and most preferably sodium, and n is a number of from 1 to 6, preferably from about 2 to about 4.

These compounds are also generally known as alkali metal alcohol ether sulfates or alkali metal alcohol ethoxy sulfates. Examples of suitable compounds as component (A) include sodium, potassium or lithium salts of lauryl ether sulfates, decyl ether sulfates, myristyl ether sulfates, dodecyl ether sulfates, stearyl ether sulfates, and the like. These compounds can be used individually or as mixtures of two or more. For example, commercially available alcohol ether sulfates may include mixtures of two or more of these compounds. Generally, the alcohol ether sulfates are prepared by reacting the alcohol with ethylene oxide at mole ratios to give the desired value for n in formula (I). Usually, the number of moles of ethoxy groups will vary and n will represent an average value corresponding to the desired number.

The alkali metal ether sulfates should be essentially free of any impurities or unreacted components, reaction intermediates, or by-products, etc. that may deleteriously affect the properties of the final bleach product composition. Some small amount of these undesired impurities such as metal ions, salts, unreacted alcohols, etc. are present in commercially available alkali metal ether sulfates, and can be tolerated. Preferably, the concentration of these undesired impurities in commercial ether sulfates is less than about 3.0%, especially preferably less than about 1.5%, by weight on an anhydrous basis.

Particularly good results have been obtained with Calfoam ES-30 (a product of Pilot Chemical Company, a 30% aqueous solution of sodium lauryl ether sulate with an average of 3 moles ethoxy per mole alcohol). Other examples of the alkyl ether sulfate surfactants as component (A) include Neodol 25-3S, (a products of the Shell Chemical Company), and Steol 4N (a product of the Stepan Chemical Company).

The component (A) anionic surfactant is present in the thickener additive in an amount within the range of from about 3% to about 40%, preferably from about 8% to about 35%, based on the total of (A)+(B)+(C). The actual amount of component (A) will be selected according to the particular compound being used, as well as the specific compounds and amounts thereof chosen as components (B) and (C) in order to provide the required viscosity and shelf life for the intended use of the thickened hypochlorite composition.

The component (B) alkali metal salts are acid salts derived from the reaction of N-alkyl substituted amino acids of the formula:

$$R_1—NH—CH_2—COOH \quad (II)$$

where $R_1$ is a linear or branched chain lower alkyl of from 1 to 4 carbon atoms, especially a methyl, for example, aminoacetic acids such as N-methylaminoacetic acid (i.e. N-methyl glycine or sarcosine), N-ethylaminoacetic acid, N-butylaminoacetic acid, etc., with saturated natural or synthetic fatty acids having from 8 to 18 carbon atoms, especially from 10 to 14 carbon atoms, e.g. lauric acid, and the like.

The component (B) salts have the following formula:

$$R_2—\overset{\overset{\displaystyle O}{\|}}{C}—\underset{\underset{\displaystyle R_1}{|}}{N}—CH_2—COO^-M^+ \quad (III)$$

where M and $R_1$ are as defined above and $R_2$ represents a hydrocarbon chain, preferably a saturated hydrocarbon chain, having from 7 to 17 carbon atoms, especially from 9 to 13 carbon atoms.

Specific examples of the compounds of formula (III) as component (B) include, for example, sodium lauroyl sarcosinate, sodium myristoyl sarcosinate, sodium stearoyl sarcosinate, and the like, and the corresponding potassium and lithium salts.

These compounds can be used singly or as mixtures of two or more. As with the component (A) compounds, the component (B) compounds should be essentially free of any undesired impurities or unreacted materials that may deleteriously affect the properties of the final bleach product composition. However, if there are any such impurities, or unreacted materials or intermediates, by-products, etc., the total amount of these unwanted ingredients is preferably less than about 1.7%, especially preferably less than about 1.0%, by weight on an anhydrous basis.

Particularly good results have been obtained with Hamposyl L-30 (a product of W. R. Grace & Co. —30% aqueous solution of sodium lauroyl sarcosinate). Similar aqueous solutions of sodium cocoyl sarcosinate and sodium myristoyl sarcosinate are also available from W. R. Grace & Co. under the trademarks Hamposyl C-30 and Hamposyl M-30, respectively. Sarkosyl NL-30 (a product of the Geigy Chemical Corporation), Medialan KA (a product of the American Hoechst Corporation), and Maprosil 30 (a product of the Onyx Chemical Company), are other examples of sarcosinate anionic surfactants which can be used as component (B).

The component (B) anionic surfactant is present in the thickener additive in an amount within the range of from about 10% to about 50%, preferably from about 10% to about 35%, most preferably from about 10 to about 30%, based on the total of (A)+(B)+(C). As with the component (A) surfactant the actual amount of component (B) will be selected according to the particular compound being used as well as the specific compounds being used as the other surfactant components of the thickener additive in order to provide the required viscosity and shelf life for the intended use of the thickened hypochlorite composition.

The component (C) alkali metal salts of alkyl sulfates are compounds of the general formula:

$$R_3SO_4^-M^+ \quad \text{(IV)}$$

where $R_3$ represents a linear or branched alkyl group of from about 8 to about 18 carbon atoms, preferably from about 10 to about 14 carbon atoms, and M is as previously defined.

Examples of compounds of formula (IV) include sodium, potassium and lithium salts of decyl sulfate, lauryl sulfate, myristyl sulfate, dedecyl sulfate, and the like. These compounds may be used individually or as mixtures of two or more.

Once again, it is important to select the component (C) anionic surfactant to be substantially free from impurities, salts, intermediates and by-products that may deleteriously affect the properties of the final bleach product composition. Accordingly, the amount of any such impurities should be preferably less than about 3.0%, especially preferably less than about 1.5%, by weight on an anhydrous basis.

Particularly good results have been obtained using Sipex NCL, a high purity aqueous solution—about 29 wt. percent solids—of sodium lauryl sulfate, which is substantially free from sodium chloride and contains about 0.2% sodium sulfate, and which is a trademarked product of Alcolac, Inc., Maryland. High purity sodium lauryl sulfate powder is also available as Maprofix 563 (a trademarked product of Onyx Chemical Co.). Other suitable commercially available alkyl sulfate anionic surfactants include Stephanol WA-100 (a product of the Stepan Chemical Company), and Conco Sulfate WR (a product of the Continental Chemical Company).

The component (C) anionic surfactant is present in the thickener additive in an amount within the range of from about 30% to about 75%, preferably from about 40% to about 70%, most preferably from about 45% to 65%, by weight based on the combined weights of (A)+(B)+(C). The actual amount of component (C) in the thickened hypochlorite composition should be selected according to the other surfactant components of the thickener additive in order to provide a stable product viscosity and hypochlorite in concentration, as well as to prevent phase separation.

The thickener additive composition can be prepared by simply mixing, with good stirring, or shear blending, all three components simultaneously or in any order. Each of the anionic surfactant components may be added to the other anionic components as their aqueous solutions or emulsions, although it is also possible to add one or two components (A), (B) and (C) as powders to an aqueous solution or emulsion of the remaining component(s). It is also possible to blend the components (A), (B) and (C), each in powder form. Optionally, if desired, this blended powdery thickening additive may be dissolved or emulsified in a quantity of water to form the mixed anionic surfactant composition before using the composition to thicken the aqueous hypochlorite solution. Mixing can be effected at room temperature, although generally temperatures in the range of from about 70° F. to about 190° F. can be used. The pressure during mixing can be atmospheric pressure, although higher or lower pressures can be used.

The concentration of the impurities in the thickener additive is generally satisfactory when the impurities contained in the individual anionic surfactant components (A), (B) and (C) is at or below the especially preferred levels therefor mentioned above. Discretion must be used when one or more of the components (A), (B) and (C) contains impurities at or above the preferred value to ensure that the thickener additive does not have an excess amount of these impurities. This is especially true when the surfactant component(s) having the higher impurity level represents a majority concentration of all anionic surfactant components in the thickener additive.

The total concentration of the thickener additive composed of anionic surfactant components (A), (B) and (C) in the mixed anionic surfactant composition is not particularly critical and can be chosen with regard to the viscosity requirements of the intended end product and the concentration requirements of the hypochlorite compound in the end product bleaching composition. For example, because the concentration of the alkali metal hypochlorite for a drain opening concentration should be in the range of from about 3.0% to about 8.0%, the mixed anionic surfactant composition may provide enough water to dilute the starting unthickened aqueous hypochlorite solution to within the desired concentration. To obtain the desired concentration water may also be added to dilute the the aqueous alkali metal hypochlorite solution or the bleach composition concentrate at any time during manufacture. When other components such as sodium hydroxide, sodium silicate, etc., which may be included in the composition, are added as aqueous solutions, the amount of water added with these other components should also be taken into consideration.

When the mixed anionic surfactant composition is in the form of an aqueous solution or emulsion, the amount of the thickening additive should not be so great that the viscosity of the composition is too high to be handled conveniently when being mixed with the aqueous solution of the hypochlorite, for example, during pumping, pouring, mixing, etc. On the other hand, the concentration of thickening additive in solution should not be so low that addition of the mixed surfactant composition provides product bleach compositions of improper specification. Taking into consideration the amount of water provided by the other constituents, and the viscosity desired of the mixed surfactant composition for mixing purposes, thickening additive in an aqueous solution or emulsion form of the mixed surfactant composition may be in the range of from about 5 to about 50% by weight, although these ranges are not critical.

Preferably, the range is from about 10 to about 40% by weight, most preferably from about 15 to about 30%. Commercially available solutions of individual components (A), (B), and (C) are typically in the range of from about 25 to 40% by weight.

A particularly useful thickened liquid composition according to the invention for clearing clogged drains, especially those with P-traps, is as follows:

| | WEIGHT PERCENT | |
|---|---|---|
| | Broad | Preferred |
| alkali metal hypochlorite | 3.0–8.0 | 3.0–6.0 |
| alkali metal hydroxide | 0.5–10.0 | 1.0–6.0 |
| alkali metal silicate | 0.3–5.0 | 0.3–2.5 |
| thickener additive | 0.5–6.0 | 0.5–5.0 |
| water | q.s.100 | q.s.100 |

Most preferably the range for alkali metal hydroxide is between about 1.0 to about 2.5% by weight, and for the thickener additive between about 0.5 to about 3.0% by weight. The proportions of anionic surfactant components (A), (B) and (C) in the thickener additive component are selected to provide a product viscosity in the range of from about 25 to about 150 cps, preferably from about 30 to 100 cps, especially from about 30 to 60 cps, when the composition is intended for clearing clogged drains with P-traps, or in the preferred range of from about 150 to about 250 cps when the composition is intended for clearing clogged drains with S-traps, and to provide a half-life of the hypochlorite concentration of about six months, preferably one year, as measured by a percent hypochlorite loss per day, calculated by the following equation:

$$\text{Average } \%\ MOCl \text{ Loss/Day} = \left[\frac{\%\ MOCl_I - \%\ MOCl_F}{\%\ MOCl_I}\right] \times \left[\frac{100}{\text{Number of days}}\right]$$

where M=alkali metal and $MOCl_I$=initial concentration and $MOCl_F$=final concentration. Using the formula, an average loss per day of about 0.28% corresponds to a six month half life, while a value of 0.14% approximately corresponds to a one year half life of the hypochlorite concentration. Furthermore, the total thickener additive concentration in the hypochlorite composition and the proportions of components (A), (B) and (C) in the thickener additive, are chosen to provide a product shelf life of about six months as measured by the phase stability of the product stored at temperatures within the range of from about 50° F. to about 90° F., i.e. the hypochloritte composition will not separate into different phases when stored at room temperature.

These criteria of viscosity, hypochlorite ion concentration and phase stability, are generally achieved with components (A), (B) and (c) present at weight percentages of (A), (B) and (C) in the range respectively of from about 3 to about 40%, from about 10 to about 50%, and from about 30 to about 75%, preferably from about 8 to about 35%, from about 10 to about 35%, and from about 40 to about 70%. Within these ranges there may be some proportions which, depending on such factors as the specific anionic detergent compounds selected, types and amounts of impurities, concentration of hypochlorite, etc. do not satisfy these criteria. However, the selection of suitable proportions within these ranges can be accomplished by routine experimentation.

The alkali metal hypochlorite component is generally available as aqueous solutions containing anywhere from about 10 to 20% available chlorine, preferably about 12 to 18% available chlorine. The alkali metal is preferably sodium, but may also be potassium or lithium, or mixtures thereof. As made, hypochlorite solutions obtained commercially contain an equimolar concentration of the corresponding alkali chloride. With time the concentration of the alkali chloride increases according to:

$$MOCl \rightarrow MCl + \tfrac{1}{2}O_2 \uparrow .$$

The amount of alkali metal hypochlorite in the product thickened bleach composition can be in the range of from about 1 to about 12%, preferably from about 1.5 to 10%, by weight based on the total composition and depending on the intended use. As pointed out above, the drain opening compositions preferably contain from about 3.0 to 8.0% by weight of the alkali metal hypochlorite.

An alkali metal hydroxide may also be present in the thickened bleach compositions of the invention in amounts up to about 10% by weight, preferably from about 0.5 to 7% by weight, and especially preferably from about 0.5 to 4.0% by weight. The preferred hydroxides are potassium hydroxide and sodium hydroxide. Mixtures of the alkali metal hydroxides can be used.

When the compositions are intended for use in applications in which they will come into contact with metals, for example, liquid drain opener compositions, an alkali metal silicate corrosion inhibitor should also be present. Suitable amounts of the silicate are within the range of from about 0.3 to 5% by weight, preferably 0.3 to 2.5% by weight. Sodium silicate is preferred although potassium silicate can also be used.

Other optional adjuvants which are inert to the hypochlorite bleaching agent and other ingredients of the thickened bleach compositions of the invention can be used in small amounts, so long as they do not interfere with the stability of the compositions, for instance perfumes and coloring agents in amounts up to about 1.0% by weight, preferably up to about 0.50% by weight, can be added to the compositions. Scouring agents and other bleaching agents, etc. can also be included, preferably in amounts of less than about 2.5% by weight, most preferably in amounts of less than about 1.5% by weight.

The thickened bleach compositions include the aqueous alkali metal hypochlorite solution and thickener additive as essential components. In addition to its thickening function, the thickener additive may also provide a detergent or cleaning function.

To prepare the thickened bleach composition, the aqueous hypochlorite solution can be simply mixed, with sufficient stirring, with the previously prepared thickening additive composed of the aqueous mixture of the anionic surfactants (A), (B) and (C). Any other ingredients such as the alkali metal hydroxide, alkali metal silicate, or other optional adjuvants can first be added to the aqueous solution of the alkali metal hypochlorite and stirred to form a homogeneous mixture prior to mixing with the thickening additive.

It has been found that a particularly efficient method for mixing the thickening additive with the premixed aqueous solution of the alkali metal hypochlorite and any other ingredients is to simultaneously pump the thickening additive preparation and the premixed aqueous hypochlorite preparation through a static mixer. It has also been found that the alkyl sulfate tends to be difficult to disperse if added to the hypochlorite solution first. It is advantageous, therefore, to prepare a thickener premix, which may be added to the hypochlorite solution (or vice versa) in either a batch or continuous mixing process.

The invention will now be illustrated by the following representative, non-limiting examples of specific embodiments of the thickened bleach compositions according to the invention as well as by several comparative examples. In the following examples, all "parts" and "percentages" are on a "by weight" basis, unless otherwise indicated. All viscosity measurements are made at 20° C. The abbreviation "a.i." refers to active ingredient concentrations.

EXAMPLE 1

A thickening additive is prepared by mixing together the following anionic detergents:

| | | Parts |
|---|---|---|
| component (A) | Ultrasulfate SE-5[1] | 1 |
| component (B) | Sarkosyl NL-30[2] | 1 |
| component (C) | Sipon-WD[3] | 1 |

[1]an essentially alcohol-free version of Ultrasulfate SE-5, a sodium lauryl ether sulfate, obtainable from the manufacturer on request and as a 58% aqueous solution, and having 5 moles $C_2H_5O$— (a product of Witco Chemical Company)
[2]sodium lauroyl sarcosinate - 30% aqueous solution with 2% maximum sodium laurate and 0.2% maximum inorganic salts (a product of Geigy Chemical Corp.)
[3]sodium lauryl sulfate - a spray-dried powder, 95% active; 0.5% free fatty alcohols; 5% inorganic salts (a product of Alcolac Corp.)

The resulting thickening additive which is an aqueous solution of the components (A), (B) and (C) at an active detergent compound weight ratio of 0.58:0.3:0.95, is added to 97 parts of PLUNGE TM, a commercially available aqueous sodium hypochlorite containing 4.42% available chlorine when used. As with all aqueous hypochlorite solutions, PLUNGE TM contains an equimolar concentration of sodium chloride when made. Over time the hypochlorite ion concentration decreases as noted above. Similarly, the hypochlorite solution contains a minor amount, usually less than 1% of the solution by weight, of sodium hyydroxide. The resulting thickened bleach composition has a viscosity of 150 cps and contains 4.29% NaOCl. At the end of 341 days, the viscosity is 310 cps and the NaOCl concentration is 3.35%. This corresponds to an average NaOCl loss per day of $$\left(\frac{4.29 - 3.35}{4.29}\right) \times 100/341 = 0.06\%$$

per day which is equivalent to a half-life of over 2 years.

EXAMPLE 2

The thickening additive of Example 1 is reproduced except that 1 part Maprofix 563, a sodium lauryl sulfate 97% a.i. powder, a product of Onyx Chemical Co., is used in place of Sipon WD, and 1 part of Calfoam ES-30 is used in place of Ultrasulfate SE-5.

The following thickened bleach composition is prepared with this thickening additive:

| | | Parts/100 | a.i. % |
|---|---|---|---|
| Thickening Additive | Calfoam ES-30 (30%) | 1 | 0.30 |
| | Sarkosyl NL-30 (30%) | 1 | 0.30 |
| | Maprofix 563 (97%) | 1 | 0.97 |
| | NaOCl (14.89%) | 30.22 | 4.50 |
| | NaCl | — | 3.53 |
| | NaOH (50%) | q.s. | 1.8 |
| | Na silicate (40%) | 3.00 | 1.20 |
| | $H_2O$ (deionized) | q.s. | 87.4 |

In the composition above, and in the examples that follow, it is to be understood that the percent NaOCl concentration in the NaOCl solution was measured at the time of use, and that the solution contains an equimolar concentration of NaCl, as well as a small amount of NaOH. The remainder is water. Sodium hydroxide in a 50% solution was added to bring the overall hydroxide concentration to the values noted. Deionized water was added to achieve the same purpose. The silicate is a mixture of $SiO_2$ and $Na_2O$ in the ratio 3.22:1 in about a 40% solution.

The initial viscosity of this composition is 380 cps. After 153 days the viscosity is 378 cps and the NaOCl concentration is 3.86%. The average NaOCl loss per day is $$\left(\frac{4.50 - 3.86}{4.50}\right) \times 100/153 = 0.09\%$$

which is equivalent to a half-life of over 1.5 years.

When the amounts of each of the components of the thickening additive is changed from 1 part to 0.5 part the initial viscosity is 95 cps and drops to 63 cps after 129 days. The average % NaOCl loss per day for this period is 0.08%/day.

EXAMPLE 3

A thickened bleach composition is prepared with the following composition:

| | | Parts/100 | a.i. % |
|---|---|---|---|
| Thickening Additive | Calfoam ES-30 (30%) | 0.5 | 0.15 |
| | Sarkosyl NL-30 (30%) | 0.5 | 0.15 |
| | Sipex - NCL (29%) | 1.72 | 0.50 |
| | NaOCl (14.64%) | 30.74 | 4.50 |
| | NaCl | — | 3.53 |
| | NaOH (50%) | q.s. | 1.80 |
| | Na silicate (40%) | 3.0 | 1.2 |
| | $H_2O$ (deionized) | q.s. | 88.17 |

The initial viscosity of the composition is 48 cps. After 107 days the viscosity is 36 cps and the NaOCl concentration is 4.24 (0.05 average % NaOCl loss/day).

EXAMPLE 4

Thickened bleach compositions are prepared with the same a.i. concentrations of NaOCl, NaOH and silicate as in Example 3, and with the parts/100 parts of Calfoam ES-30, Hamposyl L-30 and Sipex NCl shown in Table I (see below). Also, NaOCl solution concentration may vary slightly from the concentration shown in example 3. Also, shown in Table I is the initial viscosity of the thickened compositions. The data in Table I shows the importance of carefully selecting the proportions of components (A), (B) and (C) in order to obtain the desired thickening effect.

TABLE I

| Run No. | Calfoam ES-30 | Hamposyl L-30 | Sipex NCl | Viscosity (cps) |
|---|---|---|---|---|
| (1) | 0.1 | 0.1 | 1.32 | * |
| (2) | 0.1 | 0.5 | 1.32 | 14 |
| (3) | 0.1 | 0.7 | 1.32 | 10 |
| (4) | 0.3 | 0.7 | 1.32 | 11 |
| (5) | 0.3 | 0.9 | 1.32 | 9 |
| (6) | 0.5 | 0.5 | 1.32 | 59 |
| (7) | 0.5 | 0.7 | 1.32 | 11 |
| (8) | 0.5 | 0.9 | 1.32 | 13 |
| (9) | 0.7 | 0.3 | 1.32 | 51 |
| (10) | 0.7 | 0.5 | 1.32 | 26 |
| (11) | 0.7 | 0.7 | 1.32 | 15 |
| (12) | 0.7 | 0.9 | 1.32 | 10 |
| (13) | 0.9 | 0.1 | 1.32 | * |
| (14) | 0.9 | 0.3 | 1.32 | 59 |
| (15) | 0.9 | 0.5 | 1.32 | 29 |
| (16) | 0.9 | 0.7 | 1.32 | 16 |
| (17) | 0.9 | 0.9 | 1.32 | 10 |
| (18) | 0.1 | 0.7 | 1.52 | 14 |
| (19) | 0.1 | 0.9 | 1.52 | 12 |
| (20) | 0.3 | 0.3 | 1.52 | * |
| (21) | 0.3 | 0.5 | 1.52 | 27 |
| (22) | 0.3 | 0.7 | 1.52 | 16 |
| (23) | 0.3 | 0.9 | 1.52 | 12 |
| (24) | 0.5 | 0.3 | 1.52 | 63 |
| (25) | 0.5 | 0.5 | 1.52 | 79 |
| (26) | 0.5 | 0.7 | 1.52 | 17 |
| (27) | 0.5 | 0.9 | 1.52 | 11 |
| (28) | 0.7 | 0.3 | 1.52 | 70 |
| (29) | 0.7 | 0.5 | 1.52 | 42 |
| (30) | 0.7 | 0.7 | 1.52 | 24 |
| (31) | 0.9 | 0.3 | 1.52 | 82 |
| (32) | 0.9 | 0.5 | 1.52 | 50 |
| (33) | 0.9 | 0.7 | 1.52 | 27 |
| (34) | 0.9 | 0.9 | 1.52 | 21 |
| (35) | 0.1 | 0.5 | 1.72 | * |
| (36) | 0.1 | 0.7 | 1.72 | 24 |
| (37) | 0.1 | 0.9 | 1.72 | 18 |
| (38) | 0.3 | 0.5 | 1.72 | * |
| (39) | 0.3 | 0.7 | 1.72 | 27 |
| (40) | 0.3 | 0.9 | 1.72 | 20 |
| (41) | 0.5 | 0.1 | 1.72 | * |
| (42) | 0.5 | 0.3 | 1.72 | * |
| (43) | 0.5 | 0.5 | 1.72 | 51 |
| (44) | 0.5 | 0.7 | 1.72 | 92 |
| (45) | 0.5 | 0.9 | 1.72 | 69 |
| (46) | 0.7 | 0.3 | 1.72 | 93 |
| (47) | 0.7 | 0.5 | 1.72 | 116 |
| (48) | 0.7 | 0.7 | 1.72 | 37 |
| (49) | 0.7 | 0.9 | 1.72 | 27 |
| (50) | 0.9 | 0.3 | 1.72 | 114 |
| (51) | 0.9 | 0.5 | 1.72 | 119 |
| (52) | 0.9 | 0.7 | 1.72 | 42 |
| (53) | 0.9 | 0.9 | 1.72 | 24 |
| (54) | 0.1 | 0.7 | 1.92 | 39 |
| (55) | 0.3 | 0.5 | 1.92 | 62 |
| (56) | 0.3 | 0.7 | 1.92 | 45 |
| (57) | 0.5 | 0.5 | 1.92 | * |
| (58) | 0.5 | 0.7 | 1.92 | 49 |
| (59) | 0.7 | 0.5 | 1.92 | 84 |
| (60) | 0.7 | 0.7 | 1.92 | 125 |
| (61) | 0.7 | 0.9 | 1.92 | 35 |
| (62) | 0.9 | 0.5 | 1.92 | 97 |
| (63) | 0.9 | 0.7 | 1.92 | 65 |
| (64) | 0.1 | 0.1 | 2.12 | * |
| (65) | 0.1 | 0.5 | 2.12 | * |
| (66) | 0.1 | 0.9 | 2.12 | 43 |
| (67) | 0.3 | 0.5 | 2.12 | 85 |
| (68) | 0.3 | 0.7 | 2.12 | 71 |
| (69) | 0.5 | 0.5 | 2.12 | * |
| (70) | 0.5 | 0.7 | 2.12 | 76 |
| (71) | 0.5 | 0.9 | 2.12 | 48 |
| (72) | 0.5 | 0.5 | 2.12 | 115 |
| (73) | 0.7 | 0.7 | 2.12 | 77 |
| (74) | 0.9 | 0.5 | 2.12 | 130 |
| (75) | 0.9 | 0.7 | 2.12 | 91 |
| (76) | 0.9 | 0.9 | 2.12 | 156 |

*indicates that no emulsion or solution formed.

From this data, the following general conclusions may be drawn, although these trends are not completely uniform:

as the amount of component (C) alkali metal sulfate increases, the viscosity tends to increase, as the amount of component (B) alkali metal salt of N-alkyl, N-fatty acyl amino acid increases the viscosity tends to decrease, as the amount of component (A) alkali metal sulfate salt of an ethoxylated aliphatic alcohol increases, the viscosity tends to remain steady.

EXAMPLE 5

This example shows that all three components (A), (B) and (C) are necessary to provide stable thickened liquid hypochlorite compositions. With the same a.i. concentrations of NaOCl, NaOH and silicate as in example 3, the combinations shown in Table II of two of three of the components (A), (B) and (C) anionic surfactants are included in the parts/100 parts shown in Table II. The viscosities of the resulting compositions are also shown in Table II.

TABLE II

| Run No. | Calfoam ES-30 | Hamposyl L-30 | Sipex NCl | Viscosity (cps) |
|---|---|---|---|---|
| (1) | 2.22 | 0.50 | | 4 |
| (2) | 1.36 | 1.36 | | 3 |
| (3) | 0.50 | 2.22 | | 4 |
| (4) | 0.50 | | 2.22 | * |
| (5) | 1.36 | | 1.36 | * |
| (6) | 2.22 | | 0.50 | * |
| (7) | | 0.50 | 2.22 | * |
| (8) | | 1.36 | 1.36 | 7 |
| (9) | | 2.22 | 0.50 | 4 |

*Indicates that no emulsion or solution formed.

As seen from Table II, none of the possible two surfactant combinations show any thickening effect and four of the nine combinations separate into phases.

EXAMPLE 6

A thickened bleach composition is prepared with the following composition:

| | | Parts/100 | a.i. % |
|---|---|---|---|
| Thickening Additive | Calfoam ES-30 (30%) | 0.10 | 0.03 |
| | Hamposyl L-30 (30%) | 1.67 | 0.5 |
| | Sipex NCl (29%) | 1.72 | 0.5 |
| | NaOCl (15.0%) | 40.00 | 6.00 |
| | NaCl | — | 4.71 |
| | NaOH (50%) | q.s. | 1.8 |
| | Na silicate (40%) | 3.0 | 1.20 |
| | $H_2O$ (deionized) | q.s. | 85.26 |

The initial viscosity of the composition is 88 cps. After 67 days the viscosity is 74 cps, and the NaOCl concentration is 5.82% (0.04 average % NaOCl loss/-day).

EXAMPLE 7

Thickened bleach compositions are prepared with the same a.i. concentrations of NaOCl, NaOH ad silicate as in Example 6, and with the parts/100 parts of Calfoam ES-30, Hamposyl L-30 and Sipex NCl shown in the following Table III. Again, as in example 4, the NaOCl solution concentration may vary between runs. Also shown in Table III is the initial viscosity of the thickened compositions, the final viscosity, the final hypochlorite concentration, and the length of the test period.

TABLE III

| Run No. | Calfoam ES-30/ Hamposyl L-30/ Sipex NCl | Viscosity (cps) Initial | Viscosity (cps) Final | Final NaOCl Conc. (%) | Time (Days) |
|---|---|---|---|---|---|
| (1) | 0.1/1.07/1.32 | 62 | 49 | 5.73 | 67 |
| (2) | 0.1/1.07/1.52 | * | | | |
| (3) | 0.1/1.07/1.72 | * | | | |
| (4) | 0.1/1.27/1.32 | 52 | 40 | 5.6 | 67 |
| (5) | 0.1/1.27/1.52 | 73 | 67 | 5.7 | 67 |
| (6) | 0.1/1.27/1.72 | * | | | |
| (7) | 0.1/1.47/1.32 | 41 | n/a | | |
| (8) | 0.1/1.47/1.52 | 68 | 57 | 5.74 | 67 |
| (9) | 0.1/1.47/1.72 | 109 | 88 | 5.72 | 67 |
| (10) | 0.1/1.67/1.32 | 33 | n/a | | |
| (11) | 0.1/1.67/1.52 | 54 | 47 | 5.61 | 67 |
| (12) | 0.3/0.87/1.32 | 71 | 61 | 5.64 | 67 |
| (13) | 0.3/0.87/1.32 | 47 | 41 | 5.91 | 20 |
| (14) | 0.3/0.87/1.32 | 58 | 50 | 5.9 | 26 |
| (15) | 0.3/0.87/1.52 | 96 | 84 | 5.66 | 67 |
| (16) | 0.3/0.87/1.72 | * | | | |
| (17) | 0.3/1.07/1.32 | 60 | 48 | 5.75 | 67 |
| (18) | 0.3/1.07/1.52 | 91 | 74 | 5.66 | 67 |
| (19) | 0.3/1.07/1.72 | 121 | 105 | 5.92 | 67 |
| (20) | 0.3/1.27/1.32 | 53 | 39 | 5.58 | 67 |
| (21) | 0.3/1.27/1.52 | 81 | 59 | 5.67 | 67 |
| (22) | 0.3/1.27/1.72 | 109 | 99 | 5.67 | 67 |
| (23) | 0.3/1.47/1.32 | 40 | n/a | | |
| (24) | 0.3/1.47/1.52 | 70 | 56 | 5.65 | 67 |
| (25) | 0.3/1.47/1.72 | 106 | 86 | 5.83 | 67 |
| (26) | 0.3/1.67/1.32 | 30 | n/a | | |
| (27) | 0.3/1.67/1.52 | 61 | 46 | 5.75 | 67 |
| (28) | 0.3/1.67/1.72 | 59 | 45 | 5.83 | 67 |
| (29) | 0.4/0.87/1.42 | 59 | 59 | 5.86 | 25 |
| (30) | 0.4/0.87/1.42 | 54 | 50 | 5.96 | 20 |
| (31) | 0.5/0.87/1.12 | 48 | 40 | 5.98 | 17 |
| (32) | 0.5/0.87/1.32 | 80 | 70 | 5.96 | 21 |
| (33) | 0.5/0.87/1.52 | 110 | 95 | 6.01 | 21 |
| (34) | 0.5/0.87/1.72 | 130 | 114 | 5.98 | 21 |
| (35) | 0.5/1.07/1.52 | 88 | 76 | 5.96 | 21 |
| (36) | 0.5/1.27/1.52 | 60 | 42 | 5.38 | 109 |
| (37) | 0.5/1.27/1.72 | 90 | 60 | 5.37 | 109 |
| (38) | 0.5/1.27/1.92 | 137 | 93 | 5.39 | 109 |
| (39) | 0.5/1.27/2.12 | 176 | 121 | 5.4 | 109 |
| (40) | 0.5/1.47/1.52 | 77 | 55 | 5.63 | 67 |
| (41) | 0.5/1.47/1.72 | 111 | 82 | 5.72 | 67 |
| (42) | 0.5/1.47/1.72 | 116 | 83 | 5.58 | 67 |
| (43) | 0.5/1.67/1.32 | 30 | n/a | | |
| (44) | 0.5/1.67/1.52 | 50 | 44 | 5.68 | 67 |
| (45) | 0.5/1.67/1.72 | 102 | 71 | 5.63 | 67 |
| (46) | 0.9/1.67/1.72 | 57 | 45 | 5.3 | 109 |
| (47) | 0.9/1.67/1.92 | 100 | 68 | 5.35 | 109 |
| (48) | 0.9/1.67/2.12 | 144 | 99 | 5.4 | 109 |

What is claimed:

1. A mixed anionic surfactant composition capable of thickening an aqueous solution of an alkali metal hypochlorite, said composition comprising a thickening additive consisting essentially of a mixture of (A) at least one alkali metal sulfate salt of an ethoxylated aliphatic alcohol in an amount of from about 3 to about 40 percent by weight, based on the total weight of (A), (B) and (C), and (B) at least one alkali metal salt of an N-alkyl, N-fatty acyl amino acid in an amount of from about 10 to about 50 percent by weight, based on the total weight of (A), (B) and (C), and (C) at least one alkali metal salt of an alkyl sulfate in an amount of from about 30 to about 75 percent by weight based on the total weight of (A), (B) and (C).

2. The composition of claim 1 wherein (A) is at least one compound of the formula (I):

$$RO(CH_2CH_2O)_nSO_3^-M^+ \quad (I)$$

wherein R represents an aliphatic group of from about 8 to about 18 carbon atoms, M represents sodium, potassium or lithium, and n is a number of from about 1 to about 6;

(B) is at least one compound of formula (III):

$$R_2-\overset{\overset{\displaystyle O}{\|}}{C}-\underset{\underset{\displaystyle R_1}{|}}{N}-CH_2-COO^-M^+ \quad (III)$$

wherein $R_1$ is a linear or branched chain lower alkyl of from 1 to 4 carbon atoms, $R_2$ represents a hydrocarbon chain having from 7 to 17 carbon atoms, and M is as previously defined and (C) is at least one compound of formula (IV):

$$R_3SO_4^-M^+ \quad (IV)$$

wherein $R_3$ represents a linear or branched alkyl of from about 8 to about 18 carbon atoms, and M is as previously defined.

3. The composition of claim 2 wherein the amounts of (A), (B) and (C), each based on the total weight of the thickening additive, are as follows:

(A) from about 8 to about 35%, (B) from about 10 to about 35%, and (C) from about 40 to about 70%, and wherein R is an aliphatic group of from 10 to 14 carbon atoms, n is a number of from about 2 to 4, $R_1$ is methyl, $R_2$ is a saturated hydrocarbon chain of 9 to 13 carbon atoms, $R_3$ is a linear or branched alkyl of 10 to 14 carbons, and M is as previously defined.

4. The composition of any one of claims 1, 2 or 3 wherein M is sodium.

5. The composition of claim 2 wherein (A) is sodium lauryl ether sulfate having from 2 to 4 ethoxy groups, (B) is sodium lauroyl sarcosinate, and (C) is sodium lauryl sulfate.

6. The composition of any of claims 1, 2, 3 or 5 wherein the amounts of (A), (B) and (C), each based on the total weight of the thickening additive, are as follows:

(A) from about 8 to about 35%, (B) from about 10 to about 30%, and (C) from about 45 to about 65%.

7. The composition of any one of claims 1, 2, 3 or 5 which is in the form of an aqueous solution or emulsion of the thickening additive.

8. The composition of claim 7 wherein the concentration of the thickening additive is in the range of from about 5 to about 50% by weight of the total mixed anionic surfactant composition.

9. The composition of claim 8 wherein the concentration of the thickening additive is in the range of from about 15 to 40.

10. A shelf-stable thickened aqueous liquid alkali metal hypochlorite bleaching composition comprising (a) from about 1 to about 12% by weight of an alkali metal hypochlorite, (b) from about 0 to about 10% by weight of an alkali metal hydroxide, (c) from about 0 to about 5% by weight of an alkali metal silicate, and (d) the mixed anionic surfactant composition of any one of claims 1, 2, 3 or 5 in an amount sufficient to provide a total amount of the thickening additive to provide a viscosity of at least 25 centipoises, a half-life of the alkali metal hypochlorite concentration of about six months, and a phase stability of about six months.

11. The composition of claim 10 wherein the concentration of the thickening additive is in the range of from about 0.3 to about 7% by weight of the total composition.

12. The composition of claim 10 wherein the akali metal hypochlorite is from about 1.5 to about 10%, the alkali metal hydroxide is from about 0.5 to about 7%, the alkali metal silicate is from about 0 to about 3%, and the thickening additive is from about 0.5 to about 5%.

13. The thickened aqueous hypochlorite bleaching composition of claim 12 wherein the mixed anionic surfactant composition (d) comprises a thickening additive consisting essentially of from about 8 to about 35% (A), based on the total weight of (A), (B) and (C).

from about 10 to about 30% (B), based on the total weight of (A), (B) and (C), from about 45 to about 65% (C), based on the total weight of (A), (B) and (C), said thickened composition having a viscosity in the range of from about 25 centipoises to about 250 centipoises.

14. A thickened aqueous liquid drain opener composition for chemically unclogging clogged drains which comprises (a) from about 3 to about 8% by weight of an alkali metal hypochlorite, (b) from about 0.5 to about 10% by weight of an alkali metal hydroxide, (c) from about 0.3 to about 5% by weight of an alkali metal silicate, (d) from about 0.5 to about 6.0% by weight of a thickening additive, said thickening additive consisting essentially of (A) from about 3 to about 40% by weight of the total additive of at least one alkali metal sulfate salt of an ethoxylated aliphatic alcohol, (B) from about 10 to about 50% by weight of the total additive of at least one alkali metal salt of an N-alkyl, N-fatty acyl amino acid, and (C) from about 30 to 75% by weight of the total additive of at least one alkali metal salt of an alkyl sulfate, said composition having a viscosity in the range of from about 25 centipoises to about 250 centipoises, a half-life of the alkali metal hypochlorite concentration of about six months, and a phase stability of about six months.

15. The drain cleaner composition of claim 14 wherein the alkali metal hypochlorite is from about 3.0 to about 6.0%, the alkali metal hydroxide is from about 1.0 to about 6%, the alkali metal silicate is from about 0.3 to about 2.5%, and the thickening additive is from about 0.5 to about 5.0%.

16. The drain cleaner composition of claim 15 wherein the alkali metal hydroxide is from about 1.0 to about 2.5%, and the thickener additive is from about 0.5 to about 3.0%.

17. The drain opener composition of any one of claims 14, 15 or 16 wherein said thickening additive (d) consists essentially of (A) sodium lauryl ether sulfate having from 2 to 4 ethoxy groups, (B) sodium lauroyl sarcosinate, and (C) sodium lauryl sulfate wherein the amounts of (A), (B) and (C) in the composition provide a viscosity in the range of from about 30 to about 150 centipoises.

18. The drain opening composition of claim 17 wherein the viscosity is in the range of from about 30 to about 100 centipoises, the alkali metal hypochlorite concentration half life is about one year, and the phase stability is about one year.

19. A method of chemically unclogging clogged drains, the method comprising contacting the clog with an effective amount of the drain opener composition of any one of claims 14, 15 or 16, and allowing said composition to remain in contact with the clog whereby the clog is dissolved so that water can flow freely through said drain.

20. The method of claim 19 wherein said clogged drain includes a P-trap, said drain opener composition having a viscosity in the range of from about 30 to about 100 centipoises.

21. A method of chemically unclogging clogged drains, the method comprising contacting the clog with an effective amount of the drain opener composition of claim 17, and allowing said composition to remain in contact with the clog whereby the clog is dissolved so that water can flow freely through said drain.

22. The method of claim 21 wherein said clogged drain includes a P-trap, said drain opener composition having a viscosity in the range of from about 30 to about 100 centipoises.

* * * * *